United States Patent [19]

Zelenka

[11] Patent Number: 5,014,039

[45] Date of Patent: May 7, 1991

[54] DOOR ANSWERING AND INTRUDER ALERT APPARATUS AND METHOD

[76] Inventor: Jerry L. Zelenka, 4410 N. Henley Ct., Westlake Village, Calif. 91361

[21] Appl. No.: 422,099

[22] Filed: Oct. 16, 1989

[51] Int. Cl.[5] ..... G08B 13/00

[52] U.S. Cl. ..... 340/565; 340/328

[58] Field of Search ..... 340/565, 328, 329, 566

[56] References Cited

U.S. PATENT DOCUMENTS

| | | | |
|---|---|---|---|
| 4,344,071 | 8/1982 | Allen | 340/565 |
| 4,361,767 | 11/1982 | Pelka et al. | 340/565 |
| 4,476,554 | 10/1984 | Smith et al. | 340/565 |
| 4,544,920 | 10/1985 | Hamlin | 340/565 |

*Primary Examiner*—Reinhard J. Eisenzopf

*Assistant Examiner*—Geoff Sutcliffe

*Attorney, Agent, or Firm*—John S. Christopher

[57] ABSTRACT

A self-contained and portable door answering and intruder alert apparatus having a magnetic tape recording device comprised of a highly sensitive microphone receiving circuit for capturing noise generated by a person located at the door of a structure and including a tape cassette operated in a timed sequential manner by an appropriate electronic circuit for transmitting to the person one of a plurality of messages prerecorded on the cassette prior to the unauthorized entry of the structure by the person, the timed sequence being synchronized and the apparatus being switched in order to permit each message to play in its entirety for preventing loss of continuity of each message.

18 Claims, 5 Drawing Sheets

RELAY 110
RELAY 310
RELAY 144
RELAY 320
RELAY 326
RELAY 334
(RELAY ENERGIZED)
240 SEC
0
1
10
15
20
30
40
50
60
(TIME IN SECONDS)

DOOR ANSWERING AND INTRUDER ALERT APPARATUS AND METHOD

BACKGROUND OF THE INVENTION

This invention relates to magnetic tape systems for use in door answering devices, and more particularly, to magnetic tape systems of the type having noise activated triggering circuitry for transmitting a prerecorded message to a person generating noise from outside the door of a structure.

In the field of electrical communications design, voice and noise activated relays are well known particularly in radio transmission. Noise activated relays were used by amateur as well as professional radio operators for eliminating the requirement of depressing the press-to-talk switch each time the operator spoke into the, communications microphone. In this application, the operator's voice would be transmitted over the airways as long as the operator continued to talk. However, after a few seconds of silence, the transmission, would cease until the relay was reactivated by the operator's voice.

Other examples of the use of voice/noise activated relays included operating tape magnetic systems of the past and computer activated systems employed for operating smoke/fire detection systems. Such a detection system sensed the elements of combustion, announced via synthetic voice circuitry the presence of the elements of combustion, completed a communications telephone circuit to an area fire department, and activated a local fire control system. The activated fire control system thereafter energized an electrical solenoid for releasing water or chemical retardant from a fire main.

Current uses of voice/noise activated relays and switches occur in magnetic tape recorders for preventing silent gaps on the tape caused by pauses in the audible noise level. Under these conditions, recording only occurs in the presence of audible sound. This application occurs in the use of voice-activated tape recorders and has the advantages of economizing on time and magnetic tape. However, when voice/noise activated recorders are employed, mechanically actuated linkage is utilized to initially set the machine in the "record" mode. Under these conditions, the linkage positions the magnetic head and the capstan rollers in contact with the magnetic tape. Thereafter, the presence or absence of voice actuation determines if a drive motor will move the magnetic tape to record material or stop the motor and permit the tape to stand. This stop and go action of the magnetic tape is acceptable for temporary periods for eliminating the silent gaps on the tape. However, prolonged stationary contact of the magnetic head and the capstan roller is undesirable due to the magnetic construction of the head and the tape. In addition, the circular construction of the rubber capstan can become distorted after being in this stationary position for an extended period of time. Thus, a means for releasing the head and capstan from the tape during periods of non-operation is necessary for protecting the system components from excessive wear.

Other uses of voice/noise activated devices included switching electrical appliances such as lamps. Such a device was placed in a dark hallway and was activated by the voices of or the noise created by persons entering the hallway area. The lamp would then be energized by the switching action for providing illumination in the hallway. After the area was vacated, the absence of voice/noise would subsequently result in deenergizing the lamp. Further applications of voice/noise activated systems included devices which sensed a voice with a receiver-microphone circuit and thereafter actuated controls for recording the voice.

As can be seen, voice-activated relays and switches can and have been employed in a wide variety of applications. However, such voice/noise activated relays have not normally been utilized in burglar sensing devices because of false triggering circuit characteristics. It would be undesirable to have a siren or bell sound each time a voice/noise was intercepted by a microphone receiving circuit associated with the device. Therefore, infrared detectors, motion detectors, glass breakage detectors and other switching devices were common choices in alarm system design for detecting unauthorized entry and intrusion.

In certain complex computerized alarm systems, voice synthesized announcements have been employed for indicating when a particular monitored zone was violated. These systems were usually limited to industrial applications which included complex sensing devices and wiring schemes. Only in an industrial application could such an elaborate and costly system prove cost effective. However, completely computerized home management systems have been available on the market and perform a plurality of tasks automatically. Such systems can control electrical and electronic devices in an energy efficient manner and act to protect the structure against intruders. The devices, which are generally very expensive, rely on infrared sensors and an intrusion detection system that will operate lights, bells, or other alarm devices. Once an intruder is detected, an alarm activates and will deactivate only upon the recognition of a voice previously stored in the computer memory.

In light of the foregoing, there does not exist a voice/noise activated device which incorporates a magnetic recording system for playing a prerecorded message to an intruder upon the sensing of a voice or noise prior to entry by the intruder into the structure. Only after entry into the structure do the alarm systems of the past detect the intruder and thereafter sound an alarm or project a recorded message. Once the intruder has entered the structure, it takes but a short time to commit a larceny and escape. In order to create an image that the resident was at home, appliances such as the electric lights, radios and televisions were left operating. Such an image discouraged the unauthorized intrusion by burglars.

Hence, those concerned with the development and use of voice/noise activated intrusion devices in the electrical communications field have long recognized the need for improved intrusion devices which create the image that the resident is at home for deterring burglaries prior to the occurrence of a break-in, announces a plurality of prerecorded messages in a timed fashion after a voice or noise has been detected, exhibits a high level of sensitivity which permits capturing the sound of a door knock or a door bell when initiated from a distant location, employs hardware including electronic solenoids for minimizing wear on system components, is self-contained and portable requiring no additional sensing devices for operation, and is an economical burglary deterrent compared to other systems of the past. The present invention fulfills all of these needs.

SUMMARY OF THE INVENTION

Briefly, and in general terms, the present invention provides a new and improved door answering and intrusion alert apparatus construction which substantially improves the image that the resident is at home by announcing one of a plurality of prerecorded messages after a voice or noise has been detected, and which significantly improves the deterrence of a burglary prior to the occurrence of a break-in. Moreover, the apparatus construction of the present invention announces the plurality of prerecorded messages in a timed fashion, employs hardware including electronic solenoids for minimizing wear on the system components, is self-contained and portable requiring no additional sensing devices for operation, exhibits a high level of sensitivity which permits capturing the sound of a door knock or a door bell when initiated from a distant location, and is an economical burglary deterrent compared to other systems of the past.

Basically, the present invention is directed to an improved door answering and intrusion alert apparatus and method of construction for creating the image that the resident is at home. Such an image is effective in deterring burglaries prior to the occurrence of a break-in. This is accomplished by announcing one of a plurality of prerecorded messages after the voice of or a noise produced by a person at the door of a structure is detected.

In accordance with the invention, the detection of noise at the door of a structure by a sensitive microphone circuit causes relay and microphone components incorporated within the invention to convert the projected noise into an electrical signal and to activate the play mode of the magnetic tape device contained therein for transmitting one of the plurality of prerecorded messages to the person who was the source of the noise.

In accordance with the improved method of the present invention, the microphone circuit is disabled once the projected noise is converted into an electrical signal which operated a voice activated relay. Thereafter, a separate circuit is actuated for determining when the play mode of the magnetic tape machine operates while yet another related circuit provides a timer control function for determining when the tape machine should stop. The circuitry also functions to energize and deenergize a plurality of electrical sockets built into the apparatus and utilized for operating separate auxiliary components.

The new and improved door answering and intruder alert apparatus and method of construction of the present invention creates the image that the resident is at home and can take some action against the intruder prior to the occurrence of a break-in. Further, the plurality of recorded messages are announced in a timed fashion permitting each taped announcement to play through termination so that the next play mode actuation triggers a completely new announcement. Because the apparatus is self-contained, portable, and exhibits a high level of sensitivity, it is useful for monitoring the communication efforts of infants and invalids in addition to being an economical burglary deterrent.

These and other features and advantages of the invention will become apparent from the following more detailed description, when taken in conjunction with the accompanying drawings, which illustrate, by way of example, the features of the invention.

DETAILED DESCRIPTION OF THE PREFERRED EMBODIMENT

Figure 1:
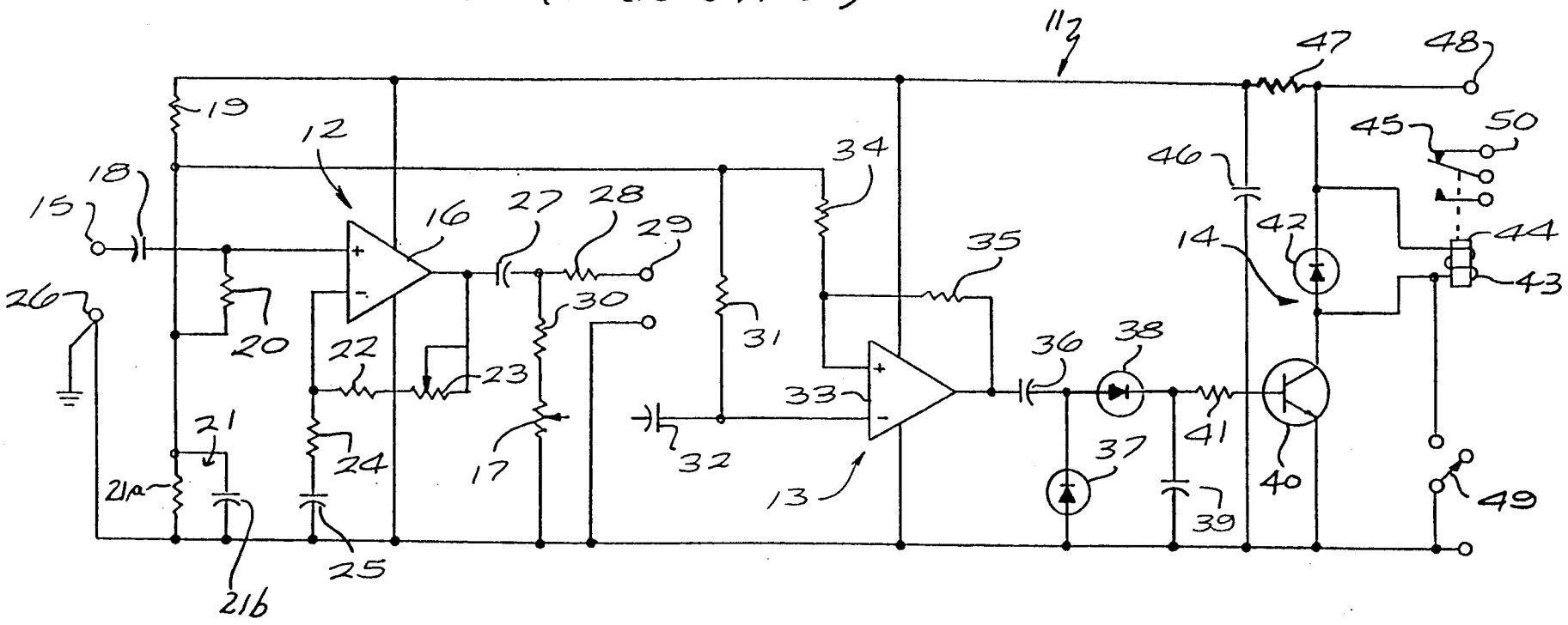
FIG. 1 (PRIOR ART)
FIG. 1 is a circuit diagram of a voice activated circuit of the prior art.

As shown in the drawings for purposes of illustration, the invention is embodied in a door answering and intruder alert apparatus 100 of the type having a magnetic tape recording device 102 comprised of a microphone receiving circuit 104 for capturing noise generated by a person located at the door of a structure and including a tape cassette 106 for transmitting to said person one of a plurality of messages prerecorded on said cassette.

The intrusion alarm industry has become very popular and is now widely accepted by the public because of the high frequency of larceny carried out against home and business owners. It is now very common for owners of residential and business property to make initial investments in alarm and security systems and to, thereafter, contract for alarm monitoring services by private enterprise. The essence of such systems is to detect the break-in resulting from a burglary, which at Common Law, was defined as occurring only at night. However, more instances are being reported by the authorities which involve break-ins of structures during the daylight hours. It is noted that the common theme of all the alarm and intrusion systems of the past is that the system activated only after the intrusion has occurred. It is known that once the intruder has entered the premises, it takes but a short time to complete the larceny associated with the burglary.

Voice activated relays have been known and utilized in the past by both amateur and professional radio operators to eliminate the need to operate a press-to-talk switch while transmitting. The voice activated relay was operated each time the microphone received an audible signal which permitted operators to have free use of their hands while transmitting. Today, voice activated relays and switches are utilized in magnetic tape recording devices for eliminating silent gaps or background hiss in the absence of audible noise. Additional applications were found in energizing auxiliary electrical equipment and in some very sophisticated electronic residential management systems.

Generally, the use of voice or noise activated relays has not been popular in burglary deterrence industries because of the false triggering characteristics associated therewith. It would be entirely unacceptable for a local audible alarm or a silent (help summoning) alarm to trigger each time a stray voice or noise was intercepted by the microphone receiving circuit. Far more preferable would be an alert system which created the image that the resident was at home and which directly interfaced with the potential intruder via a prerecorded message prior to the occurrence of a break-in. Such a system which employs modern durable hardware, which is sufficiently sensitive to intercept noise in an adjacent room, is self-contained and portable, and is economical is not known.

Many circuits of the past have incorporated voice operated relays and such a circuit 11 is disclosed in FIG. 1 as an example. The circuit is a multi-functional, voice operated relay which has a plurality of uses. When employed with transmitting equipment, it eliminates the need to depress the press-to-talk switch every time the operator speaks. However, when utilized to control a tape recorder, the circuit eliminates long gaps of background hiss when program material is missing. The circuit 11 is comprised of three main parts which include a microphone preamplifier circuit 12, a Schmitt trigger circuit 13, and a relay driver circuit 14 as shown in FIG. 1. Noise or voice act as input signals and are intercepted by a capacitive microphone input terminal 15 which converts the sound waves into a small electrical signal. The signals are fed to a microphone preamplifier 16 within the preamplifier circuit 12.

Once the signals are amplified, they are transferred to a threshold control comprised of a resistor (potentiometer) 17. Various other components are incorporated into the input and preamplifier circuits. They include an input capacitor 18, a pair of resistors 19, 20, an RC filter 21 comprised of a resistor 21*a* and a capacitor 21*b*, a pair of feedback and gain resistors 22, 23, a series resistor 24 and capacitor 25 combination providing a path to electrical ground 26, and a direct current blocking capacitor 27 and a series resistor 28 connected to a microphone output terminal 29. The threshold resistor 17 is connected to electrical ground 26 and to the cathode of the blocking capacitor 27 via a resistor 30.

In electrical communication with a resistor 31 is a threshold capacitor 32 which leads to the inverting input of an operational amplifier 33 of the Schmitt trigger circuit 13. Connected to the non-inverting input of the operational amplifier 33 is an input resistor 34 and a feedback resistor 35. The output of the operational amplifier 33 is connected to another blocking capacitor 36. When a preselected threshold voltage level at resistor 17 is exceeded, the output of the operational amplifier 33 immediately rises to a high voltage level and is rectified by a combination of diodes 37, 38 for producing a voltage which charges a capacitor 39. The voltage on capacitor 39 forward biases a transistor 40 through a biasing resistor 41. The transistor becomes conductive while a diode 42 permits current to flow through the transistor in only a single direction. Connected in parallel across the diode 42 is a magnetizing coil 43 associated with a relay 44 having a plurality of electrical contacts 45.

Connected in parallel across the transistor 40 and the diode 42 is a capacitor 46 which is in communication with a resistor 47, the combination providing control and regulation of the nominal direct current voltage present at a terminal 48. The direct current voltage is employed for large signal biasing of the operational amplifiers 16, 33 and of the transistor 40. Finally, a manual override switch 49 is placed in series with the relay 44 so that the relay can be energized manually when neither transistor nor diode 42 is conductive. However, when the override switch is open circuited and the transistor 40 and diode 42 are conductive, relay 44 is energized for changing the normal positions of the electrical contacts 45. The contacts are connected to a plurality of contact terminals 50 which in turn can be connected to other electrical circuits for controlling the operation thereof.

Notwithstanding the above example, devices of the prior art are not available which intercept voice or noise waves and immediately transmit a prerecorded announcement to a potential intruder at the door of the structure prior to the occurrence of a break-in, with the announcement indicating that some action has been taken against the intruder.

In accordance with the present invention, an input microphone 108 and a primary noise activated relay 110 cooperate to convert the projected noise into an electrical signal and to energize each of the remaining circuits when properly switched such that the apparatus 100 actuates the play mode of the recording device 102 for announcing in its entirety one of the plurality of prerecorded messages via a strategically located external speaker 112, and to provide the necessary timing sequence for activating the stop mode for discontinuing the operation of the recording device at the termination of the announcement. Further, apparatus 100 creates the image that the resident is at home which provides a deterrent against burglary prior to the occurrence of a break-in, exhibits a high level of sensitivity in the microphone receiving circuit 1O4 for capturing noise generated at the door, and is self-contained and portable making the apparatus useful for monitoring infants and invalids as well as an economical burglary deterrent.

Figure 2:
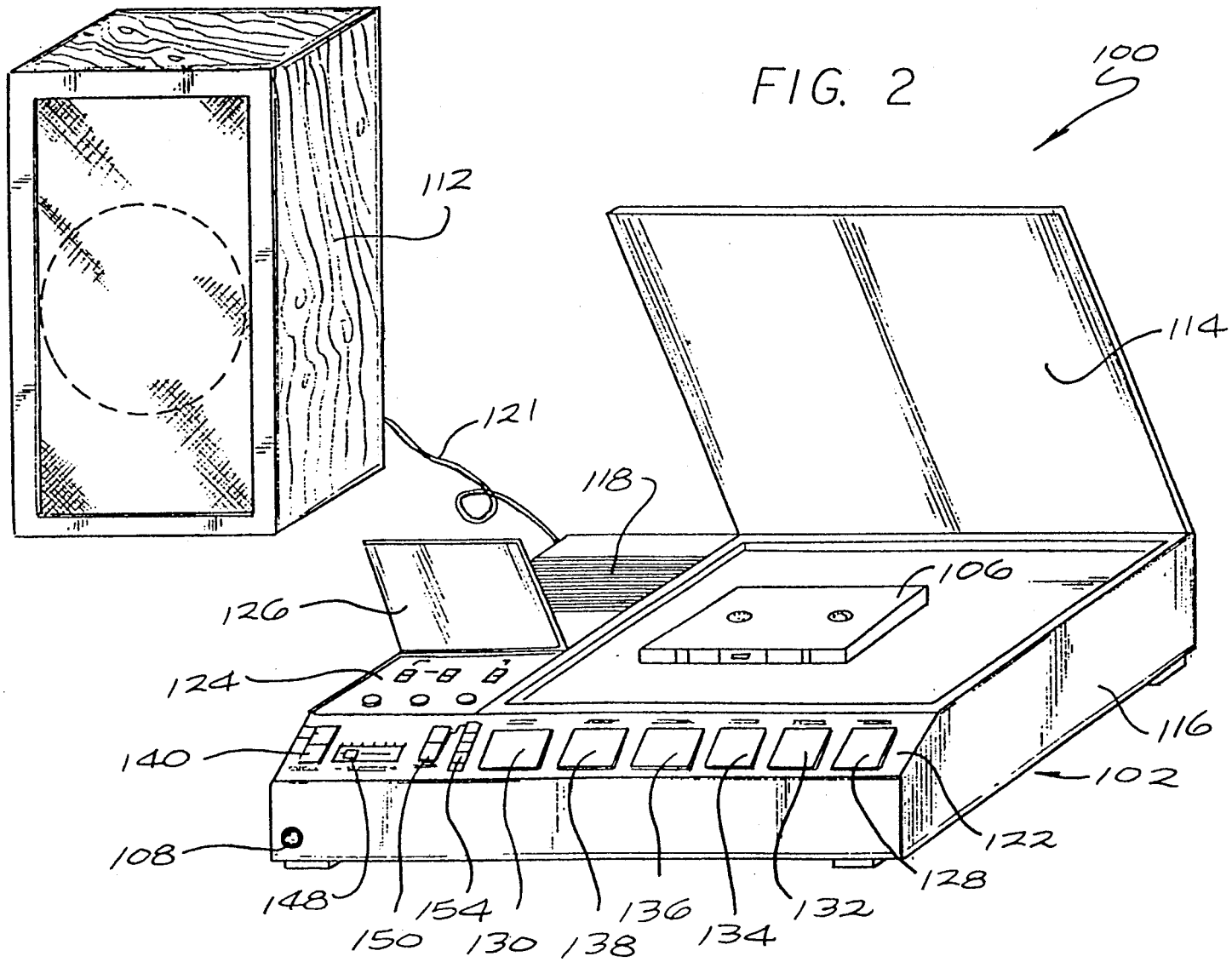
FIG. 2 is a perspective view of a door answering and intruder alert apparatus in accordance with the present invention.
Figure 4:
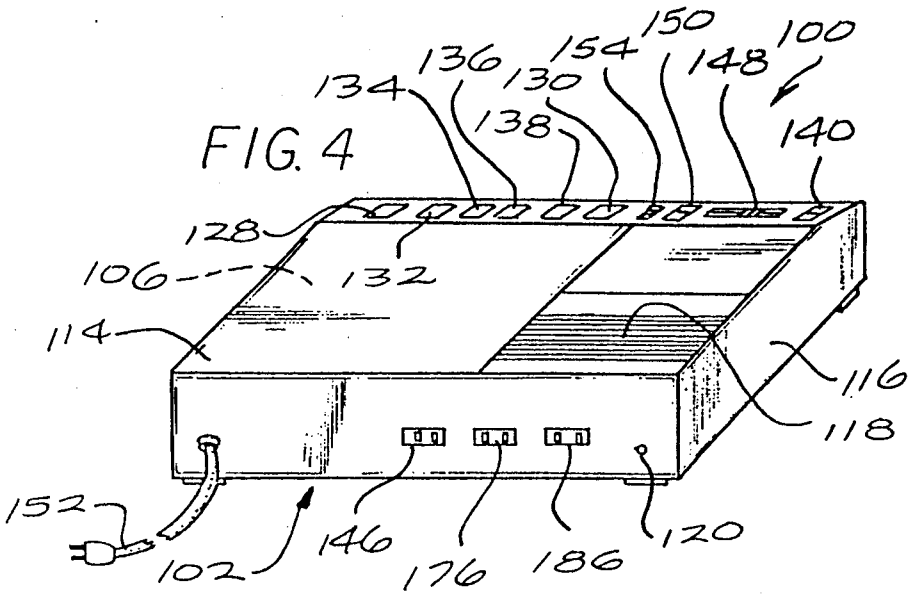
FIG. 4 is a rear perspective view of the door answering and intruder alert apparatus of FIG. 2.

The apparatus 100 includes a lid 114 for securing a housing 116 utilized for enclosing the tape cassette 106 of the recording device 102 as is shown in FIG. 2. The housing 116 further includes an internal speaker 118 utilized for reviewing announcements after recorded on the cassette. The external speaker 112, which is employed for directing prerecorded announcements to a person at the door of the structure, is physically plugged into a receptacle 120 located on the rear side of the apparatus 100 as is shown in FIG. 4. Such a connection is completed by utilizing a standard communication line 121 having male and female jacks located at each end. Note that when the external speaker is utilized, the internal speaker is disconnected.

Mounted on the forward portion of the housing 116 is a control panel 122 which includes a plurality of control buttons externally mounted. Also, an auxiliary control panel 124 is mounted within the housing 116 behind the control panel 122 but forward of the internal speaker 118. The auxiliary panel 124, described hereinafter, also includes a hinged cover 126. The control panel 122 includes a record button 128 which is used for actuating the magnetic tape device 102 for recording the plurality of announcements stored on the cassette 106. In order to record, the record button 128 and a play button 130 must be actuated simultaneously for completing the circuitry that places the machine in the record mode. Further, a pause button 132 is available for temporarily stopping the recording device 102 when operated in the manual mode. Additionally, a fast forward button 134 temporarily alters the circuitry for permitting the tape cassette 106 to be rapidly advanced, a rewind button 136 permits reversing the polarity to a drive motor (not shown) associated with the recording device such that the cassette can be driven in the reverse direction, a stop button 138 disconnects the power source to the drive motor of the recording device, and the play button 130 connects the power source to the drive motor for driving the tape cassette.

Figure 3:
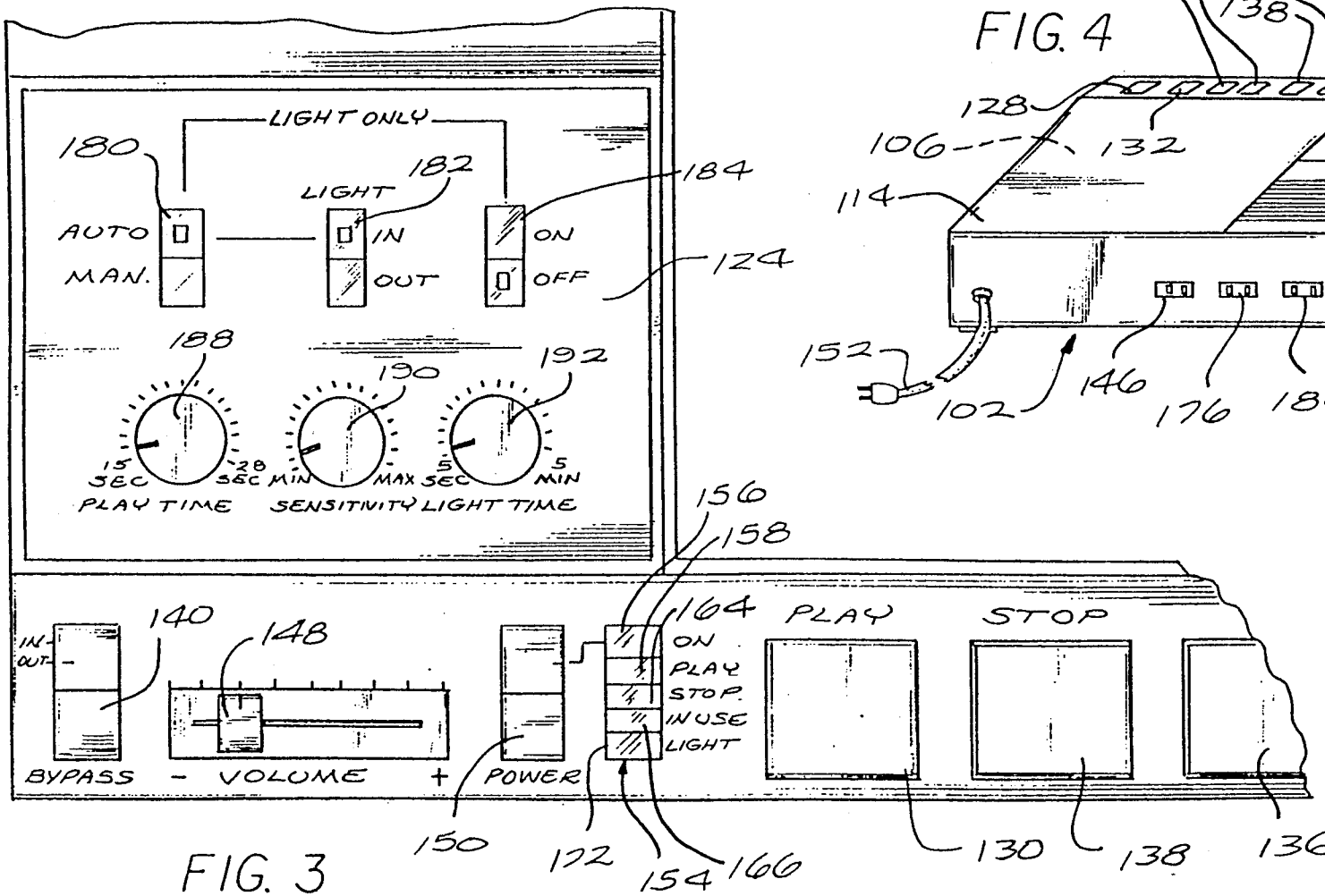
FIG. 3 is a front elevational view of a control panel of the door answering and intruder alert apparatus of FIG. 2.

The remaining controls located on the control panel 122 includes an "in-out" bypass switch 140 (shown best in FIG. 3) which is electrically wired into the primary winding of a power supply transformer 142. The switch 140 is employed for bypassing a disabling circuit relay 144 which normally supplies electrical power to a first auxiliary socket 146 mounted on the rear side of the apparatus 100 as shown in FIG. 4. The first socket 146 can be utilized for electrically connecting an external receiver-amplifier (not shown) to the control circuitry of the Apparatus 100, if desired. The source of the external receiver-amplifier could be a stereo radio receiver set and the bypass switch 140 can be utilized to switch the receiver-amplifier into and out of the control circuitry. On the contrary, if the Apparatus 100 is deenergized, the receiver-amplifier mounted within the radio or other equivalent device is available for use after properly positioning the switch 140. The "in" position of switch 140 bypasses disabling relay 144 and continuously supplies power to socket 146. In the "out" position, the switch 140 is open-circuited and socket 146 is energized only when disabling relay 144 is energized.

Also included on the control panel 122 is a volume control 148 for controlling the sound level of both the internal speaker 118 and the external speaker 112. A main power switch 150 is provided for connecting a source of 120VAC, single phase, 60 hertz power delivered through a standard power cord 152 to the control circuitry of the Apparatus 100. Finally, a luminaire block 154 is mounted on the control panel 122 and includes a plurality of light emitting diodes (LED) for transmitting information concerning the operation of the apparatus 100. An "on" LED 156 electrically wired into the secondary side of transformer 142 indicates via a red light that the main power switch 150 is closed. A "play" LED 158 wired into a time control (stop) circuit 160 indicates via a green light that the recording device 102 is in the operational play mode and that a play mode circuit 162 is energized. A "stop" LED 164 also wired into the time control (stop) circuit 160 indicates via a red light that the tape cassette 106 is not moving. An "in-use" LED 166 wired into a (microphone) disabling circuit 168 indicates via a orange light that a microphone (receiving) circuit 104 is deactivated after interception of a noise (sound) wave. Finally, a "light" LED 172 connected to an auxiliary activation circuit 174 indicates via a yellow light that a second auxiliary socket 176 mounted on the rear side of the Apparatus 100 is energized.

The auxiliary panel 124 includes a plurality of control parameters which determine the mode of operation of the Apparatus 100. Included therein is an auto-manual switch 180, an auxiliary "in-out" light switch 182, and an auxiliary "on-off" light switch 184. With the "on-off" light switch 184 in the "on" position, the "in-out" light switch 182 in the "in" position, the auto-manual switch 180 in the "auto" position, and the microphone circuit 104 activated, only a lamp or other appliance electrically connected to one of the three auxiliary sockets will be energized. This condition is referred to as the "light-only" position. The three auxiliary sockets are located on the rear side of the recording device 102 and include the first auxiliary socket 146, the second auxiliary socket 176, and a third auxiliary socket 186 as shown in FIG. 4. The first socket 146, in addition to being utilized for energizing an external receiver-amplifier (not shown) for announcing messages, can also be employed for energizing a lamp or appliance as can the second and third sockets 176, 186. The sockets are energized from different circuits with the first socket 146 being connected to the disabling circuit 168, the second socket 176 being connected to the auxiliary activation circuit 174, and the third socket being connected to the power transformer 142.

If the "on-off" light switch 184 is in the "off" position and the "in-out" light switch 182 is in the "out" position while the auto-manual switch 180 is in the "auto" position, the recording device 102 operates in an automatic mode but the auxiliary lamp is extinguished. However, if the auto-manual switch 180 is placed in the "manual" position, all the automatic features are eliminated and thus the microphone receiving circuit 104 does not respond to projected voice or noise. When the "in-out" light switch 182 is placed in the "in" position, both the tape recording device 102 and one of the auxiliary sockets 146, 176, or 186 will be energized. However if the "in-out" light switch is repositioned to the "out" position, the recording device will still be activated automatically but an electric light connected to the appropriate auxiliary socket will be extinguished.

Three rotary knobs are also positioned on the auxiliary panel 124 for controlling various parameters. They include a playtime control 188, a sensitivity control 190, and a light timer control 192. The playtime control, which is adjustable for a time period within the range of (15–28) seconds, determines the time allotted for recording an announcement and likewise the time allotted for playing the prerecorded announcement once noise is detected. The sensitivity of the microphone receiving circuit 104 is determined by the position of the sensitivity control 190. Thus, the sensitivity can be adjusted so that only a low level of noise is required before the input microphone 108 senses the sound waves produced by the projected noise. The input microphone is shown as being mounted in the housing 116 of the Apparatus 100 in FIG. 2 but can be mounted elsewhere. Finally, when an electric lamp is plugged into auxiliary socket 176, the position of the light timer control 192 determines the time that the lamp will glow once energized. The time range is designed to be from five seconds to five minutes.

Figure 5:
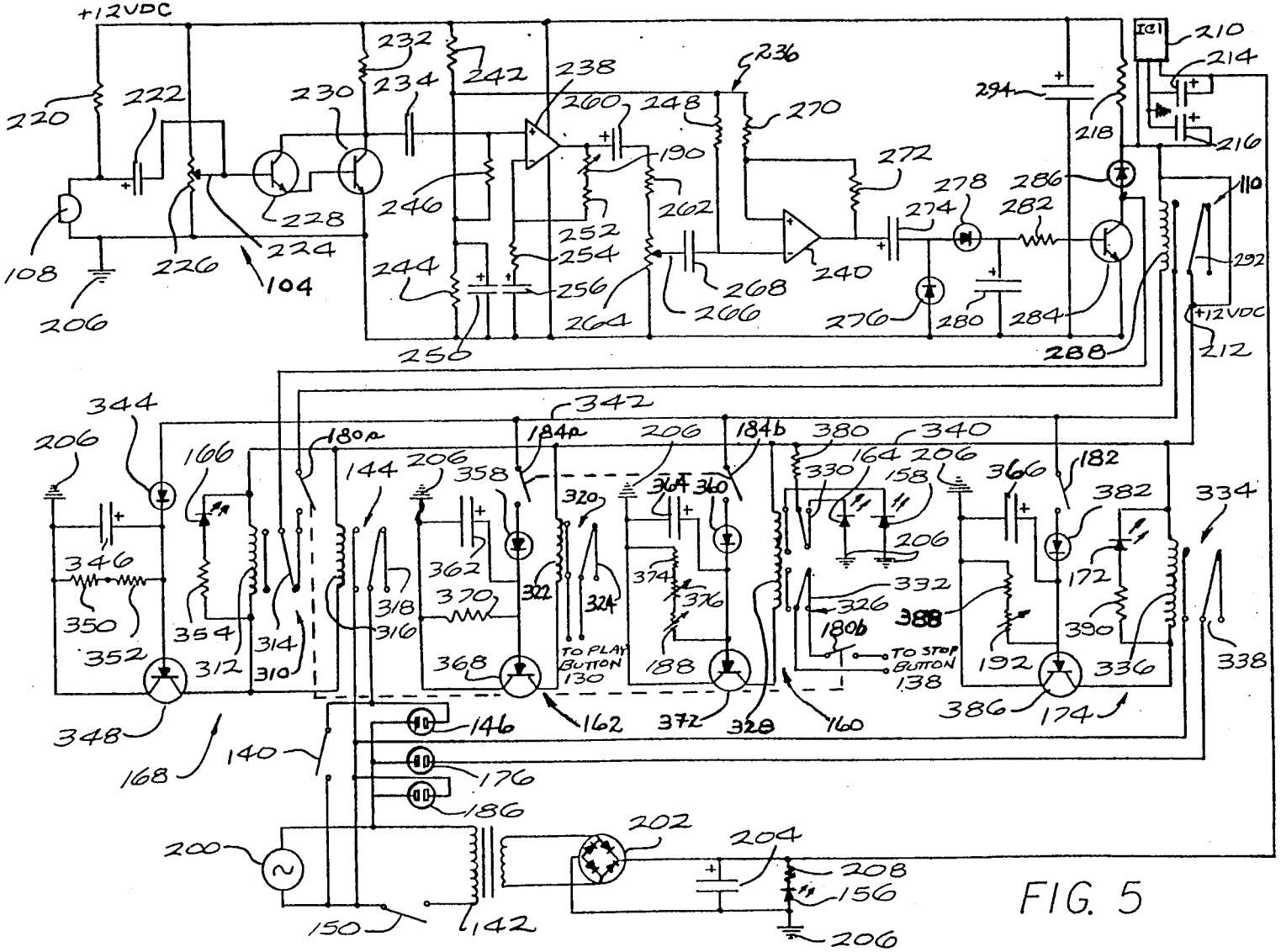
FIG. 5 is a circuit diagram of the door answering and intruder alert apparatus of FIG. 2.

By way of example and not by limitation, a plurality of electronic components comprising the control circuitry of the Apparatus 100 will now be discussed. An example of such circuitry is illustrated in FIG. 5. The Apparatus receives the 120VAC, single phase, 60 Hertz power from a source 200 which can be a standard wall receptacle. Once the main power switch 150 is closed, electric current flows through the primary winding of transformer 142. When the secondary winding of the transformer is loaded, the secondary voltage is stepped-down to approximately 12VAC. The secondary winding of the transformer is connected to a full wave bridge rectifier 202 which provides a pulsating D.C. voltage which is filtered by a capacitor 204 connected to electrical ground 206. Connected in parallel with the capacitor 204 is a resistor 208 in series with the "power on" LED 156 which, in turn, is connected to ground. The resistor 208 provides a discharge path for the capacitor 204 and power to illuminate the LED 156. The filtered D.C. voltage is then transmitted to a voltage regulator 210 which provides a positive regulated D.C. voltage at point 212. Oscillations in the filtered D.C. voltage received by regulator 210 are smoothed out by a capacitor 214 while a similar function is performed on the regulated D.C. voltage at point 212 by a capacitor 216.

Beginning with the microphone receiving circuit 104, the positive 12VDC located at point 212 is impressed upon resistors 218, 220 which provides a path for power to the condenser input microphone 108. When the microphone 108 intercepts voice or noise, an A.C. small signal is developed by transducer action charging a capacitor 222 which serves to block D.C. voltage and passes the small signal A.C. voltage to a wiper pin 224 of a trimmer potentiometer 226. Because potentiometer 226 is indirectly connected to the D.C. voltage at point 212, a large signal bias voltage is impressed on the base terminals of a pair of preamplifier transistors 228, 230 as shown in FIG. 5. Potentiometer 226, which is permanently adjusted during the assembly process, sets the D.C. bias for the transistor pair 228, 230 for optimum amplification. The emitter terminal of transistor 228 is connected to the input base terminal of the transistor 230 while the collector terminals of both transistors are connected together. The output voltage signal of the transistor pair is developed across a resistor 232 which permits the charging of a capacitor 234. Capacitor 234 blocks any D.C. component of the signal and acts as an input terminal to a dual operational amplifier 236.

The amplifier 236 is comprised of two independent operational amplifiers 238, 240. Each of the independent operational amplifiers 238, 240 are biased by the same large signal through a voltage divider circuit comprised of a pair of resistors 242, 244. This voltage divider combination couples the D.C. (large signal) biasing voltage to the non-inverting input of operational amplifier 238 through a resistor 246 and further couples the biasing voltage to the inverting input of the operational amplifier 240 via a resistor 248. A capacitor 250 decouples the voltage divider circuit and serves to filter undesirable audio signals of certain frequencies to ground 206. The small signal gain amplification of amplifier 238 is controlled by the sensitivity control potentiometer 190 (shown in FIG. 3) in series with a resistor 252, each contributing to form a feedback loop across amplifier 238. The potentiometer 190 is mounted on the auxiliary control panel 124 and is the main sensitivity control of the input microphone 108. A resistor 254 in series with a capacitor 256 are connected to the inverting input of amplifier 238 and serve to pass certain frequencies present in the feedback loop to ground 206.

The A.C. output signal (small signal) emitted from amplifier 238 is coupled to the inverting (trigger) input of operational amplifier 240 via a capacitor 260, a load resistor 262, a potentiometer 264 having a wiper terminal 266, and a capacitor 268. Capacitor 260 blocks any D.C. component and passes the (AC) small signal through resistor 262 and into potentiometer 264 which is permanently adjusted during assembly. The potentiometer 264 establishes a pre-determined threshold voltage level at the input of operational amplifier 240 which, when exceeded, permits amplifier 240 to conduct. The threshold voltage is exceeded due to the presence of the A.C. output signal from amplifier 238. Capacitor 268 serves to prevent the D.C. biasing voltage developed across resistor 248 from being impressed across potentiometer 264 and interfering with the small signal component.

Resistor 248 which is connected to the inverting input of amplifier 240 and a resistor 270 which is connected to the non-inverting input thereof are each provided for biasing the amplifier which operates on the A.C. small signal component. A gain resistor 272 is located in a positive feedback loop across amplifier 240. The A.C. output signal (small signal) transmitted from amplifier 240 is conducted across a series capacitor 274 and into a voltage-doubler configuration comprised of diodes 276, 278. The A.C. small signal is rectified at this point by the diodes 276, 278 for converting the small signal into a pulsating D.C. signal prior to charging a series capacitor 280. The capacitor 280 develops a signal across a resistor 282 during the discharge cycle for forwarding biasing a relay energizing transistor 284.

The rectified voltage which develops a voltage potential across resistor 282 is no longer an A.C. small signal but now serves as a D.C. large signal solely to forward bias transistor 284. Once transistor 284 is energized, it acts as a switch conducting current through a diode 286 and resistor 218. Under these conditions, a magnetizing coil 288 of the primary noise activated relay 110 is energized closing a set of normally-open relay contacts 292. Diode 286 is utilized for suppressing the inductive kickback voltage spike that is created in the magnetizing coil 288 when current passing through the relay contacts 292 of relay 110 is suddenly interrupted. Such an interruption occurs when the microphone receiving circuit 104 is disabled by the disabling circuit 168. Resistor 218 and a parallel connected capacitor 294 assist in filtering any D.C. noise component present in this portion of the receiving circuit 104.

Prior to actuating the circuitry illustrated in FIG. 5, the following initial conditions must be observed. Bypass switch 140 must be open circuited so that auxiliary socket 146 will be controlled by the disabling circuit relay 144. The main power switch 150 must be closed while a plurality of switches 180*a*, 180*b*, 182, 184*a* and 184*b* must also be in the closed position. Switch 180*a* is the disabling switch located within the disabling circuit 168 utilized for disabling the microphone receiving circuit 104. Switch 180*b* located in the time control circuit 160 is the manual stop switch associated with the stop button 138 on control panel 122. It should be noted that switches 180*a* and 180*b* are electrically independent but are mechanically interlinked. Together, the two switches form the main auto/manual switch 180 mounted on auxiliary control panel 124 shown in FIG. 3.

Switch 184*a* is the play circuit switch located in play mode circuit 162 while switch 184*b* is the time control circuit switch located within the time control circuit 160. The switches 184*a* and 184*b* are electrically independent but are mechanically interlinked. In combination, the two switches 184*a*, 184*b* form the auxiliary "on-off" light switch 184 mounted on the auxiliary control panel 124. The function of each of the switches 184*a*, 184*b* respectively is to open the play mode circuit 162 and the time control circuit 160 so that the auxiliary activation circuit 174 can operate independently without announcements from the tape cassette 106. Finally, the auxiliary "in-out" light switch 182 is located within the auxiliary activation circuit 174 which controls the switching of the second auxiliary socket 176.

The closing of the contacts 292 of relay 110 immediately activates four separate trigger circuits. The first circuit energized is the disabling circuit 168 which disables the microphone receiving circuit 104 and further energizes the 120VAC auxiliary socket 146. Then, play mode circuit 162 is energized which initiates the play mode whereafter the time control circuit 160 is activated for determining the stop time of the recording device 102 and the auxiliary activation circuit 174 is actuated for energizing the 120VAC auxiliary socket 176. Each of the above recited circuits includes at least one relay with each relay including a magnetizing coil for controlling the position of a set of contacts. The disabling circuit 168 comprises a pair of relays 310, 144, the relay 310 having a magnetizing coil 312 for controlling a set of contacts 314, while the relay 144 includes a magnetizing coil 316 for controlling a set of contacts 318.

Additionally, the play mode circuit 162 includes a relay 320 having a magnetizing coil 322 for controlling a set of contacts 324 while the time control circuit 160 comprises a relay 326 having a magnetizing coil 328 for controlling a pair of contacts 330, 332. Finally, the auxiliary activation circuit 174 comprises a relay 334 having a magnetizing coil 336 for controlling a set of contacts 338. Each set of contacts 318, 314, 324, and 338 in each of the relays 144, 310, 320, and 334 are single-pole, double-throw type contacts. However, the pair of contacts 330, 332 of relay 326 form a double-pole, double-throw arrangement for switching two electrical loads simultaneously. Also note that each of the magnetizing coils 312, 316, 322, 328, and 336 are connected to a positive 12VDC from a line 340 connected to contact 292 of noise activated-relay 110. Once a continuity is established to each circuit 160, 162, 168 and 174 via a line 342, a complete circuit will exist to line 340 and to relay 110.

Once the contacts 292 of relay 110 close, a positive voltage is impressed on a diode 344 causing a capacitor 346 to charge. The discharge cycle of the capacitor 346 places a positive voltage on the gate terminal of a FET transistor 348 permitting current to flow across the source and drain terminals. Such a current flow energizes the magnetizing coils 312 and 316 of relays 310 and 144. The normally closed contacts 314 of relay 310 open while the normally open contacts 318 of relay 144 close. Such action opens the circuit of relay 110 for a fixed period of thirty seconds so that an uninterrupted cycle of play and stop modes can commence. The thirty second period is regulated by the values of a pair of resistors 350, 352 which are in parallel with and act as the discharge path for the charged capacitor 346. The fixed total resistance of resistors 350, 352 has been designed to create the thirty second delay at the nominal voltage of 12VDC. Any noise sensed by the input microphone 108 during this thirty second period will not result in relay 110 being energized since contacts 314 of relay 310 are open circuited. Capacitor 346 charges very rapidly and thereafter begins to discharge from the positive plate through resistors 350, 352 to ground 206. The discharge rate is controlled by the resistive values which adjust the timing cycle and thus the length of the pause period.

With the magnetizing coil 312 of relay 310 energized, current also passes through a resistor 354 and the "in-use" LED 166 for providing a visual indication that the Apparatus 100 is operating. Once capacitor 346 has discharged, FET transistor 348 ceases to conduct deenergizing the magnetizing coils 312, 316 causing contacts 314 to close and contacts 318 to open. The closing of contacts 314 permits the microphone receiving circuit 104 to reset to a stand-by mode. Therefore, if noise is sensed by the microphone 108, the microphone receiving circuit can once again convert the sound waves into an electrical signal and energize primary noise activated relay 110. The operation of relay 144 is simultaneous with the operation of relay 310. Thus, relay 144 is energized for thirty seconds permitting contacts 318 to close completing a circuit to auxiliary socket 146. Socket 146 can be utilized to provide power to an optional receiver-amplifier (not shown) to further enhance the acoustical response of the announcement stored on the cassette 106. However, a separate receiver-amplifier is not necessary for the operation of the invention since the internal amplifier is sufficient to drive the external speaker 112. Notwithstanding, the separate receiver-amplifier is available as an option to enhance the acoustic parameters of the area being monitored. In the alternative, the socket 146 could be utilized to energize an electric light or appliance for the thirty second period. At the end of the pause period, relay 144 is deenergized eliminating power to socket 146. During periods when the Apparatus 100 is not being utilized, bypass switch 140 is available to return normal operation to the equipment housing the separate receiver-amplifier, such as a stereo system.

Besides disabling the microphone receiving circuit 104 and energizing socket 146, disabling circuit 168 performs another important function. The disabling circuit initiates a timing cycle for the play mode circuit 162 and the time control circuit 160 which is consistent with the operation of the disabling circuit. This is achieved in the following manner. The timing cycle begins when voltage is removed from a pair of diodes 358, 360 respectively located in the play mode circuit 162 and the time control circuit 160. The removal of this voltage occurs with the opening of contacts 292 of relay 110. If contacts 292 were closed for more than a short time, the voltage applied at the diodes 358, 360 would maintain a pair of corresponding capacitors 362, 364 fully charged. Consequently, this fully charged condition would delay the commencement of the discharge cycles of capacitors 362, 364. Therefore, the duration of the preset capacitive discharge times would be much longer and not coincide with the timed prerecorded announcement on the cassette 106.

Relays 320, 326 are energized when voltage is first applied to their respective diodes 358, 360, which occurs when relay 110 is energized. During this time, capacitors 346, 362, 364 of circuits 168, 162, and 160 and a capacitor 366 connected in circuit 174 are charged by 12VDC. This period for which relay 110 is energized is measured in milliseconds and is a constant value fixed by the discharge rate of capacitor 346 of disabling circuit 168. Therefore, the millisecond time in which relay 110 is energized (approximately two-tenths of a second) is incorporated into the cycle time of circuits 160, 162 to become the cycle time of a constant value (see FIG. 6). Since the capacitors are charged to a certain level, the discharge of these capacitors controls the overall timing cycle of Apparatus 100. The overall timing cycle having such a constant value refers to the time determined by the two-tenths of a second in which relay 110 is energized plus the discharge time of capacitors 346, 362, 364 and 366 of circuits 168, 162, 160 and 174.

The discharge time of capacitors 346, 362 and 364 are most significant since these components are directly involved in maintaining the prerecorded announcements in synchronism with one another. As a result of the overall timing cycle having a constant value, the time for announcing a particular prerecorded message is constant for each sound wave intercepted by the input microphone 108. The playtime control 188 mounted on auxiliary control panel 124 limits the length of any announcement to the range of (15-28) seconds. Therefore, for a fifteen second announcement, the recording device 102 will operate in the play mode for fifteen seconds each time the Apparatus 100 is actuated. Thus, circuits 160, 162 are always in synchronism with the timed prerecorded announcement stored on the tape cassette 106. Because the recording device 102 was utilized initially to record each announcement, playing each prerecorded announcement will require the same period of time. It is most important to understand the significance that the disabling circuit 168 has on the proper functioning of the Apparatus 100.

The play mode circuit 162, once activated, has a cycle time of approximately one second. This is all the time that is necessary to set the Apparatus 100 into the play mode. The magnetizing coil 322 receives power from completing a circuit to line 340 which causes contacts 324 of relay 320 to close. By such action, the Apparatus 100 is placed in the play mode such that if the play button 130 mounted on the control panel 122 is operated, the capstan motor (not shown) will be driven in the forward direction. This action results when normally-open contacts 292 of relay 110 are closed permitting a positive D.C. voltage to be impressed across diode 358 causing capacitor 362 to charge. The positive side of capacitor 362 forward biases the gate terminal of an FET transistor 368.

This biasing condition establishes continuity across the source and drain terminals of transistor 368 completing an electrical circuit to line 340. As a result, an electrical current flows in the play mode circuit 162 energizing the magnetizing coil 322 of relay 320 closing contacts 324. The Apparatus 100 is then placed in the play mode by the continuity created across the play button 130 provided by the closing of contacts 324. After transistor 368 is triggered, capacitor 362 begins to discharge through a resistor 370. Because resistor 370 is assigned a small resistive value as compared to the values of resistors 350, 352, capacitor 362 discharges rapidly in approximately one second. The circuit is now postured to place the Apparatus 100 in the play mode.

The time control circuit 160 activates the tape stop mode of the recorder device 102 and also provides indication of the play and stop modes via the "play LED" 158 and the "stop LED" 164. Once normally-open contacts 292 of relay 110 close, a positive voltage is impressed on diode 360 causing capacitor 364 to charge. The charged condition of capacitor 364 places a forward bias on the gate terminal of FET transistor 372 for causing conduction between the drain and source terminals thereof. Such a conduction energizes the magnetizing coil 328 for closing the pair of contacts 330, 332 of relay 326. After transistor 372 begins to conduct, capacitor 364 begins to discharge to ground 206 through a combination comprised of a fixed resistor 374, a variable resistor 376 and the playtime control 188. The function of the variable resistive combination of resistors 374, 376, and control 188 is to adjust the cycle time of the time control circuit 160 to a maximum value of approximately twenty-eight seconds. Keep in mind that the function of the time control circuit 160 is to stop the cassette 106 at the end of both a play cycle and a recording cycle. Therefore, the cycle time of the time control circuit is somewhat shorter in duration than the cycle time (approximately thirty seconds) of the disabling circuit 168. Thus, any particular prerecorded announcement will have sufficient time to play to termination and then assume a quiet mode for at least two seconds prior to the microphone receiving circuit 104 resetting. This brief quiet mode prevents the noise associated with stopping the recording device 102 from reactivating the microphone receiving circuit so that a reset condition can be achieved.

Resistor 374 is a fixed resistance of an appropriate value while the variable resistor 376 is an adjustable trimmer potentiometer which provides a fine tuning feature. This fine tuning feature enables the total resistive value of the combination of resistors 374, 376, and control 188 to approach but be less than the resistive value of disabling circuit 168. Such a design permits the time control circuit to stop the cassette 106 at the end of a play or record cycle before the end of the cycle time of the disabling circuit. The (trimmer potentiometer) variable resistor 376 is adjusted during assembly to exhibit the resistive value necessary to provide a maximum cycle time of approximately twenty-eight seconds. No additional adjustment is required thereafter. Playtime control 188 is an adjustable potentiometer mounted on the auxiliary control panel 124 as shown on FIG. 3. The control (potentiometer) 188 is adjusted to control the time lapsed before the time control circuit 160 initiates the stop mode, e.g., how long the cassette 106 will play or record before the recording device 102 stops. The limits on the time range of the control (potentiometer) 188 has a minimum value of fifteen seconds and a maximum value of twenty-eight seconds.

Relay 326 is a double-pole, double-throw relay wherein normally-closed contacts 332 are connected to the normally-open stop button 138 while normally-closed contacts 330 are connected to the source of 12VDC on line 340 through a resistor 380. The relay contacts 330 in the normally-closed position are connected to the "stop" LED 164, while in the normally-open position contacts 330 are connected to the "play" LED 158. Each LED is also connected to electrical ground 206. In the deenergized state, the recording device 102 is in a stand-by mode with the "stop" LED 164 illuminated indicating that the stop button 138 has been operated. In the energized state, both sets of contacts 330, 332 change position opening the individual circuits containing the stop button 138 and the "stop" LED 164. After the opening of the stop circuit, transistor 368 of the play mode circuit 162 conducts energizing magnetizing coil 322 of relay 320. Operation of relay 320 causes contacts 324 to close so that the capstan motor (not shown) may be actuated by the operation of the play button 130. Additionally, contact 330 of relay 326 connects the "play" LED 158 to the source of 12VDC via resistor 380. The illuminated LED 158 indicates that the recording device 102 has been placed in the play mode by the play mode circuit 162.

The position of the switches 180*a*, 180*b*, 184*a* and 184*b* determines if the recording device 102 is in the automatic triggering mode or in the manual operation mode. When each of these switches are in the closed position, the recording device is in the automatic trigger mode. Under these conditions, the stop button 138 is closed and contacts 292 of relay 110 of the microphone receiving circuit 104 are in a stand-by (open circuited) condition. In the manual mode, switches 180*a*, 180*b* are open circuited preventing the microphone receiving circuit 104 from activating, since switch 180*a* is in series with the magnetic coil 288 of relay 110. Further, the circuit containing the stop button 138 remains open circuited and the recording device can be operated as a standard tape recording machine. Placing the recording device 102 in such a posture is useful, for example, in recording a message to a family member or in any other application in which a tape machine would be useful. In the manual mode, switches 184*a*, 184*b* may be in either the open or closed position and the Apparatus 100 will still function properly. The reason that switches 184*a*, 184*b* are incorporated in the circuitry is to remove the recording device from operation so that the Apparatus 100 can be utilized to drive only the auxiliary activation circuit 174 while in the auto mode.

The time control circuit 160 controls the time for recording a message and the time for playing back a prerecorded message. This is accomplished in the following manner. A timed recorded announcement is stored on the tape cassette 106 by placing the auto-manual switch 180 mounted on the auxiliary control panel 24 in the auto position and closing switches 184*a*, 184*b*. The playtime control (potentiometer) 188 is then adjusted to the desired time period of (15–28) seconds. Thereafter, the record button 128 is lightly tapped generating a noise which activates the microphone receiving circuit 104 and consequently the play mode circuit 162. This condition now places continuity simultaneously across the record button 128 and the play button 130 and thus actuates the record mode. The recording device 102 will remain in the record mode for the preselected time set on the playtime control 188 at which point the device automatically stops.

The auxiliary activation circuit 174 is employed primarily to switch the auxiliary socket 176 connected across the primary winding of transformer 142. When the contacts 338 of relay 334 are closed, the socket 176 is energized at 120VAC and can be utilized to energize an electrical light or other appliance as desired. The lamp or other appliance will be energized when a noise is intercepted by the microphone receiving circuit 104 and will remain energized for a preset time as determined by the setting of the light timer control 192 mounted on the auxiliary control panel 124. The timer control 192 is a potentiometer located in the capacitive discharge circuit as described below.

Once the contacts 292 of the primary noise activated relay 110 are energized, the source of 12VDC is impressed across a diode 382 causing capacitor 366 to charge. The charged capacitor forward biases the gate terminal of an FET transistor 386 permitting the transistor to conduct from the drain terminal to the source terminal. Such conduction energizes the magnetizing coil 336 of relay 334 causing the contacts 338 to close. Once the contacts 338 close, the socket 176 becomes energized. After transistor 386 begins to conduct, capacitor 366 begins to discharge through a fixed resistor 388 and the light timer control (potentiometer) 192. The capacitive discharge timing cycle is controlled by the settings of resistor 388 and timer control 192. The timer control can be adjusted for providing a minimum cycle time of five seconds and a maximum cycle time of five minutes. A resistor 390 is connected in parallel across magnetizing coil 336 for developing a potential difference thereacross and a current flow for passing through the "light" LED 172. When LED 172 is illuminated, an indication exists that socket 176 has commenced the timed control cycle. Auxiliary socket 186 is not switched and is energized at 120VAC whenever the power cord 152 is plugged into an energized 120VAC receptacle. Socket 186 can be utilized to power any auxiliary equipment that is convenient or desirable to connect to the Apparatus 100.

An example of the operation of the Apparatus 100 for a fifteen second announcement on the tape cassette 106 and a setting of fifty seconds on the light timer control 192 is described hereinbelow. A generalized timing diagram of the operation of the individual relays is as illustrated on FIG. 6. The initial conditions are that all relays are deenergized and that all switches are closed except the "in-out" bypass switch 140 which can be employed for energizing socket 146 when the Apparatus 100 is deenergized. After a noise is detected by the input microphone 108, magnetizing coil 288 of relay 110 is energized closing contacts 292. The time required for the noise (sound) wave to be translated into a signal and for the contacts 292 to change position is approximately one-tenth of a second. Immediately thereafter, the source of 12VDC from line 340 is impressed onto each of the diodes 344, 358, 360 and 382 causing the respective Capacitors 346, 362, 364 and 366 to charge over the appropriate number of time constants.

After a charge builds-up on each of the capacitors, the associated transistors 348, 368, 372 and 386 conduct passing electrical current through the respective magnetizing coils 312, 316, 322, 328 and 335. Approximately one-tenth of a second later, each of the associated sets of contacts 314, 318, 324, 330, 332 and 338 change position. Therefore, the primary noise activated relay 110 is energized for approximately two-tenths of a second as is shown on FIG. 6. This period includes the one-tenth of a second required for processing the noise (sound) wave and switching the contacts 292, and further the one-tenth of a second for switching the remaining relay contacts. This two-tenths of a second during which relay 110 is energized is referred to as the "millisecond time" which is incorporated into the cycle time of the play mode circuit 162 and the time control circuit 160 for providing a cycle time of a constant value. The two-tenths of a second is also the time period allocated for charging each of the capacitors 346, 362, 364 and 366. This design ensures that circuits 160, 162 are always in synchronism with the timed recorded announcement of the tape cassette 106.

Figure 6:
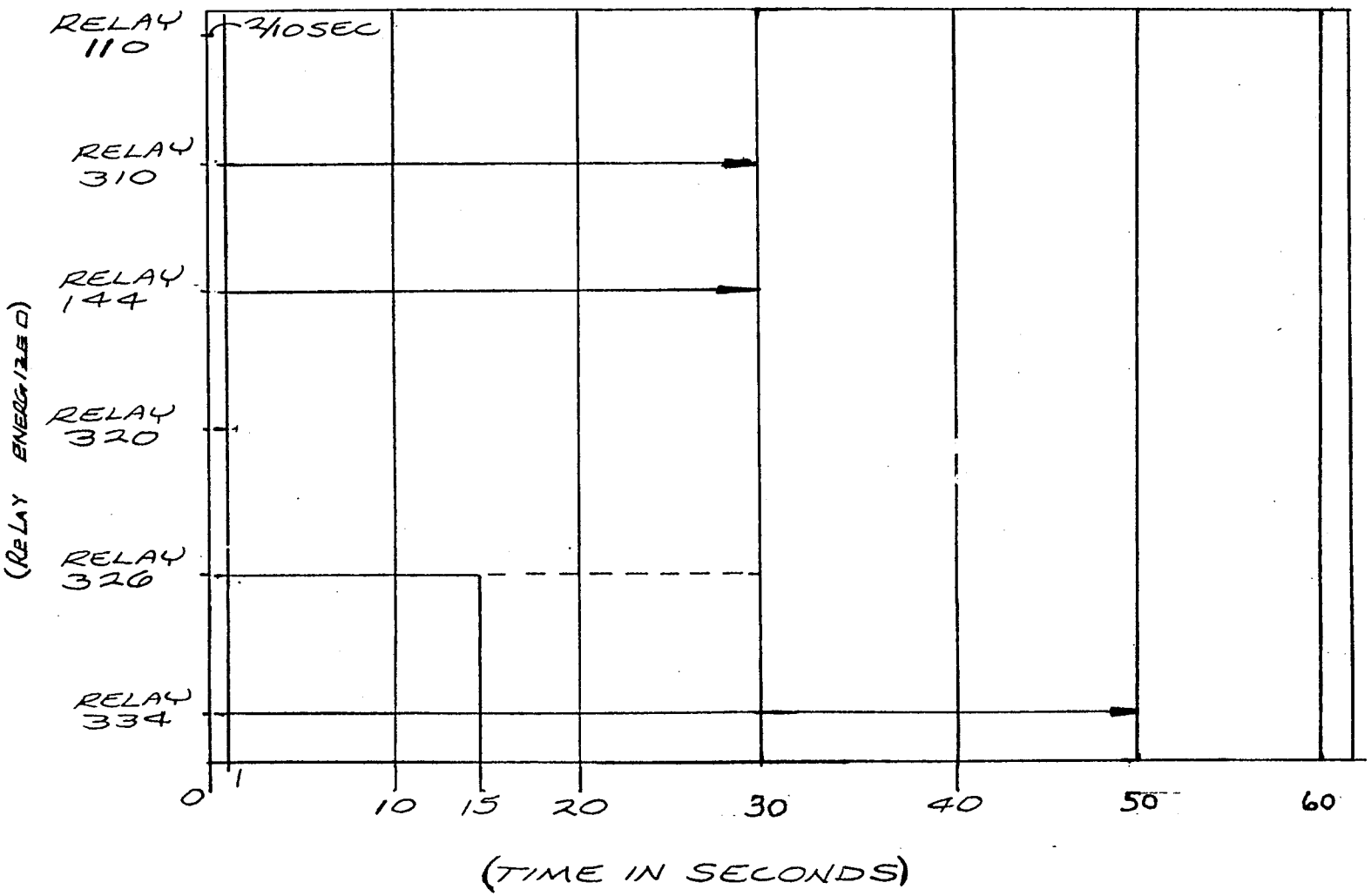
FIG. 6 is a timing cycle diagram of the door answering an intruder alert apparatus of FIG. 2.

After relay 310 is energized, contacts 292 of relay 110 open (after two-tenths of a second) as shown in FIG. 6. When contacts 314 of relay 310 open, relay 110 remains deenergized for at least thirty seconds since contacts 314 are in series with the magnetizing coil 288 of relay 110. The thirty second period in which relay 110 is deenergized is controlled by the values of resistors 350, 352 in the discharge path of capacitor 346. After capacitor 346 discharges, transistor 348 ceases conduction which deenergizes relay 310 and closes contacts 314 resetting the microphone receiving circuit 104 to a stand-by condition. Relay 110 will remain deenergized until another noise (sound) wave is intercepted by the input microphone 108. Further, the circuit 168 maintains relays 310, 144 in an energized condition for a fixed period of thirty seconds as shown in FIG. 6.

The play mode circuit 162 and relay 320 connected therein remain energized for approximately one second which is time enough to place the recording device 102 into the play or record modes. Thereafter, relay 326, being energized, commences the fifteen second period allocated for playing the prerecorded announcement while simultaneously opening contacts 332 of the stop circuit. The playtime control (potentiometer) 188 is the component utilized for adjusting the time allotted for an announcement by controlling the discharge rate of capacitor 364. The time period in which relay 326 is energized is also controlled in this manner and is shown terminating conduction at the end of fifteen seconds in FIG. 6. At the end of the fifteen second period, contacts 332 fail closed when relay 326 is deenergized. Thus, contacts 332 place a continuity across the stop button and consequently deenergize the capstan motor and magnetic head solenoids (not shown) for actuating the stop mode. The time control circuit 160 remains in a quiet (inactive) mode during the period measured between fifteen and thirty seconds awaiting the end of the thirty second cycle of the disabling circuit 168.

Finally, the socket 176 is energized by the conduction of transistor 386 and the operation of relay 334. The lamp or appliance connected to socket 176 will be operable for the period preset at light timer control (potentiometer) 192. In this example, the time has been set to fifty seconds at which point the lamp (appliance) will be extinguished as shown in FIG. 6. In the event that during the cycle time of the Apparatus 100 (as illustrated in FIG. 6), an additional noise (sound) wave is intercepted by the input microphone 108 after relay 310 is deenergized and relay 110 is reset (thirty seconds) but before the termination of the preset time on timer control 192 (fifty seconds), the following occurs. Relay 334 of auxiliary activation circuit 174 remains energized, however, capacitor 366 ceases discharging and is recharged. The recharged capacitor 366 maintains transistor 386 conductive and relay 334 energized. Assuming that the timer control 192 remains preset at fifty seconds, the energized time cycle of socket 176 is recommenced beginning at the point in the original cycle in which the additional noise is intercepted.

In accordance with the operational example disclosed above, the recitation of the following elements are by way of example and not by limitation. It is to be understood that many similar components are suitable or can be modified to be suitable for utilization in the circuitry described above. In particular, the voltage regulator 210 can be any suitable integrated circuit rated at 12VDC while the first and second operational amplifiers 238, 240 can be a single low noise BIFET dual operational amplifier. Transistors 228, 230 and 284 are each an NPN bipolar junction type while transistors 348, 368, 372 and 386 are each a power MOSFET type. Each of the diodes 276, 278 and 286 is a fifty PIV silicon rectifier diode while each of the diodes 344, 358, 360 and 382 is seventy-five PIV silicon switching diode. Further, each of the relays 110, 310 and 320 is a single-pole, double-throw micro relay while relay 326 is a double-pole, double-throw micro relay. Additionally, each of the relays 144 and 334 is a 12VDC micro relay having 10 ampere, high current contacts. Each of the resistors is appropriately sized and rated at one-quarter watt, 5% tolerance. Transformer 142 is a step down type rated at 120VAC/12VAC while rectifier 202 is a full wave bridge rectifier rated at one ampere, fifty PIV. Each of the auxiliary sockets 146, 176 and 186 is rated at 120VAC. Finally, each capacitor is appropriately sized while the input microphone 108 is a condenser type microphone.

The apparatus 100 as disclosed has utility beyond that of a door answering apparatus. Primarily, the invention is designed to project a voice from the cassette tape 106 in response to a knock at the door or a ring of the door bell. Employed as such, the Apparatus is a burglar deterrent. The invention also can energize any number of appliances via the auxiliary sockets 146, 176 and 186 as a further deterrent by projecting the image that the resident is at home. Voice, noise or any combination of sounds can be prerecorded on the cassette and later projected in a synchronized, timed fashion over an adjustable time range. The invention can thereafter disconnect and reset itself in preparation for intercepting the next audible noise wherein another prerecorded announcement is available for transmission. The next announcement can be unrelated to the preceding announcement for creating a realistic image as to why the occupant cannot answer the door. The variations in the announcements is only limited to the imagination.

The announcements are projected through the separate external speaker 112 which can be located as desired. The internal amplifier (not shown) of the Apparatus 100 is matched to the external speaker and is ample to create the desired announcement. However, the auxiliary socket 146 is available to incorporate an external amplifier (not shown) for creating an even more acoustically dramatic effect. The socket is energized and deenergized with the operation of the recording device 102 and includes the bypass switch 140 which permits use of the external amplifier when the Apparatus 100 is deenergized. As a door answering device, the invention can project announcements to welcome callers that you are otherwise predisposed at the present time. As an intruder alert device, it can be utilized to monitor a particular area and project appropriate announcements upon detection of sounds such as breaking glass, the opening of windows and doors or the like. Such an invention is useful in scaring away many uninvited and unauthorized intruders prior to a break-in of the structure.

The Apparatus 100 is also useful for monitoring those who are sick or otherwise confined to bed, including infants too small to care for themselves. With a simple noise such as a clap of the hands, knock on the wall or the cry of an infant, the monitored party can inform another of the need for help. By employing the sensitivity control 190, the monitored party can watch television or listen to the radio and not have the Apparatus 100 actuate until a noise is made that is higher in volume than the background noise already present in the room. Finally, the invention can be employed as a standard tape recorder when placed in the manual mode, as when leaving messages for other family members.

The Apparatus 100 also employs electronically energized tape head and capstan roller solenoids (not shown) which are known to be used in telephone answering machines, automobile tape cassette machines and home stereo tape deck devices. These solenoids operate by closing a circuit or placing a continuity across a function button for energizing a particular function. This design provides a simple and effective advancement over mechanical linkages used in the past to activate various functions of the recording device 102. The electronic solenoids allow for unattended operation which make them ideal for use in the Apparatus. In particular, when the recording device is in the standby or off position for long periods of time, the electronic solenoids move the capstan and magnetic head away from the magnetic tape. This feature permits avoidance of damage to the components of the recording device resulting in an extended service life. In systems of the past which employed mechanical linkage, the capstan and magnetic head were constantly in contact with the magnetic tape when the recording device was in the stand-by or off position. This situation could result in damage to the capstan. The invention is economical and portable with the only wiring required is the introduction of the power cord 152 into an electrical outlet and the plugging of the communication line 121 into the external speaker receptacle 120 . The invention is not intended to activate sirens or bells upon the detection of noise but is intended to create the image that someone is at home before an unauthorized break-in occurs.

From the foregoing, it will be appreciated that the door answering and intruder alert apparatus of the present invention permits a large number of prerecorded messages to be stored on the tape cassette 106 so that each message plays in its entirety in a timed sequential manner, and that each message can differ from every other taped message for providing the realistic image that the resident is at home. Further, the apparatus is economical to manufacture and since the message can be designed to appear that some action has been initiated against the intruder, burglaries can be deterred prior to the occurrence of a break-in of the structure.

While a particular form of the invention has been illustrated and described, it will be apparent that various modifications can be made without departing from the spirit and scope of the invention. Accordingly, it is not intended that the invention be limited, except as by the appended claims.

I claim:

1. An apparatus for responding to noise generated externally to a monitored area, said apparatus comprising, in combination:

means for recording a plurality of discrete messages on a magnetic tape and means for playing a selected one of said plurality of discrete messages when said apparatus is activated by a noise intercepted from outside said monitored area;

means for controlling said intercepted noise, said controlling means including means for receiving said intercepted noise for converting said noise to an electrical signal, said controlling means in electrical communication with said playing means;

means for adjusting the sensitivity of said apparatus to the level of said intercepted noise, said adjusting means in electrical communication with said receiving means;

means for disabling said receiving means after said noise has been intercepted, said disabling means including a control switch for controlling an electrical socket mounted within said apparatus, said disabling means in electrical communication with said receiving means; and means for actuating said playing means of said apparatus, said actuating means including a plurality of control switches for determining the mode of operation of said playing means, said actuating means being time synchronized with means for stopping said apparatus at the end of each discrete message, said actuating means and said stopping means being in communication with said controlling means, with said selected message of said plurality of discrete messages recorded on said magnetic tape being completely played without interruption after the interception of said noise from outside said monitored area, and said stopping means terminating the operation of said apparatus for resetting the controlling means.

2. The apparatus of claim 1 wherein said recording means is a tape recording device.

3. The apparatus of claim 1 wherein said magnetic tape of said recording means comprises a tape cassette mounted in said apparatus.

4. The apparatus of claim 1 wherein said controlling means is an electronic circuit for controlling said intercepted noise.

5. The apparatus of claim 1 wherein said receiving means is a microphone receiving circuit for processing input sound waves.

6. The apparatus of claim 1 wherein said adjusting means is an adjustable potentiometer.

7. The apparatus of claim 1 wherein said disabling means is an electronic circuit for deenergizing said receiving means.

8. The apparatus of claim 1 wherein said disabling means is activated by a relay within said controlling means.

9. The apparatus of claim 1 wherein said disabling means further includes a control relay in electrical communication with said receiving means for deactivating said receiving means.

10. The apparatus of claim 1 further including a potentiometer for controlling the playing time of said apparatus.

11. The apparatus of claim 1 further including a plurality of light emitting diodes for indicating the operational status of said apparatus.

12. The apparatus of claim 1 wherein said controlling means comprises at least one transistor circuit for energizing and deenergizing a control relay.

13. The apparatus of claim 12 wherein the conduction of said transistor circuit is controlled by the discharge rate of a capacitor.

14. The apparatus of claim 1 wherein said electrical socket is energized when said disabling means is energized.

15. The apparatus of claim 1 wherein said receiving means further includes means for regulating direct current voltage.

16. A door answering and intruder alert apparatus for responding to noise generated external to a monitored area comprising, in combination:

means for recording a plurality of discrete messages on a magnetic tape and means for playing a selected one of said plurality of discrete messages when said apparatus is activated by a noise intercepted from outside a monitored area appurtenant to a structure;

means for controlling said intercepted noise, said controlling means including an input microphone circuit for receiving said intercepted noise for converting said noise to an electrical signal, said controlling means in electrical communication with said playing means;

a potentiometer in electrical communication with said input microphone circuit for adjusting the sensitivity of said apparatus to the level of said intercepted noise;

a disabling circuit in electrical communication with said input microphone circuit for disabling said input microphone circuit after said noise has been intercepted, said disabling circuit including a control switch for controlling an electrical socket mounted within said apparatus; and means for actuating said playing means of said apparatus, said actuating means including a plurality of control switches for determining the mode of operation of said playing means, said actuating means being time synchronized with means for stopping said apparatus at the end of each discrete message, said actuating means and said stopping means being in communication with said controlling means, with said selected message of said plurality of discrete messages recorded on said magnetic tape being completely played without interruption after interception of said noise from outside said monitored area for creating an impression that said structure is occupied by a resident and said stopping means terminating the operation of said apparatus for resetting the controlling means.

17. The apparatus of claim 16 wherein said electrical socket is energized when said disabling circuit is energized.

18. The apparatus of claim 16 wherein said circuit for disabling said input microphone circuit is a transistorized circuit having a conduction cycle controlled by the discharge path of a capacitor.

* * * * *

UNITED STATES PATENT AND TRADEMARK OFFICE

CERTIFICATE OF CORRECTION

PATENT NO. : 5,014,039

DATED : May 7, 1991

INVENTOR(S) : Jerry L. Zelenka

It is certified that error appears in the above-identified patent and that said Letters Patent is hereby corrected as shown below:

Col. 6, line 28, delete "104" and replace with --104--;
Col. 15, line 18, delete "24" and replace with -- 124 --; and
Col. 16, line 20, delete "Capacitors" and replace with -- capacitors --.

Signed and Sealed this

Sixteenth Day of February, 1993

*Attest:*

STEPHEN G. KUNIN

*Attesting Officer*

*Acting Commissioner of Patents and Trademarks*